US009545806B2

(12) United States Patent
Mitsuya et al.

(10) Patent No.: US 9,545,806 B2
(45) Date of Patent: Jan. 17, 2017

(54) SELF-INKING STAMP

(71) Applicant: SHACHIHATA INC., Nagoya-shi, Aichi (JP)

(72) Inventors: Takayuki Mitsuya, Nagoya (JP); Takuya Koide, Nagoya (JP)

(73) Assignee: SHACHIHATA INC., Nagoya-shi (JP)

( * ) Notice: Subject to any disclaimer, the term of this patent is extended or adjusted under 35 U.S.C. 154(b) by 0 days.

(21) Appl. No.: 15/136,467

(22) Filed: Apr. 22, 2016

(65) Prior Publication Data

US 2016/0325573 A1 Nov. 10, 2016

Related U.S. Application Data

(63) Continuation of application No. 14/178,939, filed on Feb. 12, 2014, now abandoned.

(30) Foreign Application Priority Data

Feb. 15, 2013 (JP) ..... 2013-027562
May 16, 2013 (JP) ..... 2013-103813

(51) Int. Cl.

| | |
|---|---|
| ***B41K 1/02*** | (2006.01) |
| ***B41K 1/42*** | (2006.01) |
| ***B41K 1/00*** | (2006.01) |
| ***B41K 1/36*** | (2006.01) |
| ***B41K 1/40*** | (2006.01) |

(Continued)

(52) U.S. Cl.

CPC ..... *B41K 1/42* (2013.01); *B41K 1/006* (2013.01); *B41K 1/02* (2013.01); *B41K 1/36* (2013.01); *B41K 1/38* (2013.01); *B41K 1/40* (2013.01); *B41K 1/52* (2013.01); *B41K 1/54* (2013.01)

(58) Field of Classification Search

CPC ..... B41K 1/02; B41K 1/006; B41K 1/36; B41K 1/38; B41K 1/40; B41K 1/42; B41K 1/52; B41K 1/54

See application file for complete search history.

(56) References Cited

U.S. PATENT DOCUMENTS

| | | |
|---|---|---|
| 5,727,467 A | 3/1998 | Skopek |
| 6,058,840 A | 5/2000 | Poplawski et al. |

(Continued)

FOREIGN PATENT DOCUMENTS

| | | |
|---|---|---|
| JP | 2011-025659 A | 2/2011 |
| WO | 9722478 A1 | 6/1997 |
| WO | 2010085828 A2 | 8/2010 |

OTHER PUBLICATIONS

European Search Report dated Sep. 1, 2014, issued in counterpart European application No. 14154948.5 (6 pages).

*Primary Examiner* — Matthew G Marini
*Assistant Examiner* — Marissa Ferguson Samreth
(74) *Attorney, Agent, or Firm* — Westerman, Hattori, Daniels & Adrian, LLP

(57) ABSTRACT

A self-inking stamp is configured such that, in a marking preparation state, a marking member is maintained in a state in which it is oriented upwardly within a stamp body of the self-inking stamp and pressed against an ink pad to supply ink thereto, and, during a marking operation, after the inner frame is moved downwardly while being reversingly rotated and oriented downwardly, the downwardly-oriented marking member is exposed from the stamp body and enabled to make a mark. The self-inking stamp is also configured to lock the marking member in a state in which it is exposed from the stamp body, for replacement and cleaning of the marking member.

5 Claims, 8 Drawing Sheets

(51) Int. Cl.

| | |
|---|---|
| ***B41K 1/52*** | (2006.01) |
| ***B41K 1/38*** | (2006.01) |
| ***B41K 1/54*** | (2006.01) |

(56) References Cited

U.S. PATENT DOCUMENTS

| | | | |
|---|---|---|---|
| 6,892,638 | B2 | 5/2005 | Sculler |
| 7,066,089 | B1 | 6/2006 | Shih |
| 2003/0150343 | A1 | 8/2003 | Koneczny |
| 2005/0056173 | A1 | 3/2005 | Dour |
| 2010/0326299 | A1 | 12/2010 | Kamiyama et al. |
| 2011/0277647 | A1 | 11/2011 | Zindl et al. |

SELF-INKING STAMP

CROSS-REFERENCE TO RELATED APPLICATIONS

This application is a Continuation of application Ser. No. 14/178,939, filed Feb. 12, 2014, which claims priority to Japanese Patent Application No. JP 2013-027562, filed Feb. 15, 2013 and Japanese Patent Application No. JP 2013-103813, filed May 16, 2013, the entire contents of which are incorporated herein by reference.

BACKGROUND OF THE INVENTION

The present invention relates to a self-inking stamp, also called "flip type stamp", configured such that, in a non-use state thereof, it is maintained in a state in which, within a stamp body thereof, a marking member, i.e., a marking member, is oriented upwardly and pressed against an ink pad to allow ink to be applied thereonto, whereas, during use, according to a marking operation, the marking member is flipped or reversingly rotated while being moved downwardly and the downwardly-oriented marking member is exposed from the stamp body of the self-inking stamp and enabled to make a mark.

Heretofore, in this type of self-inking stamp, for performing cleaning of a marking surface and replacement of a marking member, a locking mechanism capable of holding the marking member at a downwardly-moved and exposed position during a non-marking operation. For example, in a self-inking stamp having such a locking mechanism, an inner frame is manually pushed and forcibly moved into an outer frame until the inner frame is locked to the outer frame. In this state, when an inner frame is manually pushed and forcibly moved into an outer frame until the inner frame reaches a locking position, the inner frame is locked inside the outer frame at the locking position by an action of the locking mechanism. A locked state of the locking mechanism can be released by pushing a lock release button (see, for example, the following Patent Document 1).

However, this conventional locking mechanism requires a user to push the inner frame into an innermost region of the outer frame with his/her fingertips. This lock operation is difficult for a woman using artificial nails, in addition to the lock release operation. There is another problem that, due to accidental touch with the marking surface during the pushing operation, user's fingertips are stained with ink. Further, there is no cap for the marking surface. Thus, if the stamp is carried or stored in a state in which the marking member, namely, the inner frame is locked to the innermost region of the outer frame, the exposed marking member is likely to stain clothes or a storage area with ink.

Moreover, there is a certain clearance (play) between a rotary shaft of a marking unit body holding the marking member, and a slit of the inner frame. Thus, if the marking operation is performed rapidly and severely, the stamp is likely to have problems, such as disengagement the rotary shaft of the marking unit body from a reversing guide of the inner frame, and wobble of the inner frame.

PATENT DOCUMENT

Patent Document 1: JP 2011-025659A

SUMMARY OF THE INVENTION

Technical Problem

It is an object of the present invention to solve the above problems in the conventional self-inking stamp and provide a self-inking stamp capable of locking a marking member in a state in which it is oriented downwardly and a marking surface thereof is exposed from an opening of an inner frame, in an easy and stable manner, without a need for pushing the inner frame into an innermost region of the outer frame by fingertip operation, thereby facilitating cleaning and replacement of the marking member.

It is an object of the present invention to provide a self-inking stamp capable of preventing damage to a cam mechanism and cam disengagement during a marking operation, and allowing the inner frame to be smoothly moved inside an outer frame, thereby providing excellent usability.

Solution to the Technical Problem

The present invention provides a self-inking stamp comprising: an outer frame; an inner frame configured to be movable in an upward-downward direction of the outer frame with respect to the outer frame under a bias of an elastic member, while being guided by a guide element extending in the upward-downward direction, wherein the inner frame has an upper portion fixedly provided with an ink pad oriented downwardly and a lower end formed with a marking opening for allowing a marking member to be exposed therethrough so as to make a mark, and wherein the marking member pivotally attached to a lower portion of the outer frame and configured to be flipped, namely, reversely rotated along with the upward-downward movement of the inner frame with respect to the outer frame, and the elastic member is disposed between an upper portion of the outer frame and the upper portion of the lower frame to bias the inner frame downwardly with respect to the outer frame; a locking mechanism configured to unlockably lock a positional relationship between the outer frame and the inner frame, in a state in which the inner frame is pushed inside the outer frame against a bias force of the elastically biasing member, and the marking member is exposed downwardly from the marking opening; and an inner-frame cap configured to be detachably attached to the inner frame while capping the marking opening, and pushing the inner frame upwardly with respect to the outer frame to a position where the locking mechanism becomes operative to lock the inner frame, whereby, in a marking preparation state in which the inner frame is pushed out from the outer frame and the elastic member is stretched, the marking member is pressed against the ink pad, in a marking state in which the inner frame is pushed into the outer frame and the elastic member is compressed, the marking member is exposed from the marking opening and enabled to make a mark, and in a locked state, in which the inner frame is pushed into the outer frame and the elastic member is compressed, each of outer frame-side locking pawls is engaged with a respective one of inner frame-side lockable pawls so as to protrude the marking member from the marking opening.

As used in this specification, with regard to the "upward-downward direction", in a state in which the inner frame is fixed on a horizontal plane, a direction along which the outer frame is pushed during a marking operation is defined as "downward direction", and a direction along which the outer frame is pushed back by the elastically biasing member, after the completion of the marking operation, is defined as "upward direction".

Effect of the Invention

The self-inking stamp of the present invention can lock the marking member in a state in which it is oriented downwardly and a marking surface thereof is exposed from the opening of the inner frame, in an easy and stable manner, without a need for pushing the inner frame into an innermost region of the outer frame by fingertip operation, thereby facilitating cleaning and replacement of the marking member.

In addition, the self-inking stamp of the present invention can prevent damage to a cam mechanism and cam disengagement during a marking operation, and allow the inner frame to be smoothly moved inside the outer frame, thereby providing excellent usability.

The present invention may be specifically embodied as follows.

First Embodiment

In the self-inking stamp of the present invention, the inner frame has an inner frame-side vertical concave/convex portion provided in/on an inner surface thereof to extend in the upward-downward direction, and the marking member has a marking member-side vertical concave/convex portion provided in/on an outer surface thereof in counterpart relation with the inner frame-side vertical concave/convex portion to extend in the upward-downward direction in the marking state, wherein a direction of the marking member in the marking state is restricted by an engagement between the inner frame-side vertical concave/convex portion and the marking member-side vertical convex/concave counterpart portion. "Concave/convex" is used herein to mean that one of the inner frame-side vertical portion and the marking member-side vertical portion has a convex profile and the other of the inner frame-side vertical portion and the marking member-side vertical portion has a concave profile.

Second Embodiment

In the self-inking stamp of the present invention, the inner frame has an inner frame-side concavoconvex engagement portion provided on an outer surface thereof; and the inner-frame cap has a cap-side concavoconvex engagement portion provided on an inner surface thereof, wherein, when the inner-frame cap is attached to the inner frame, the inner-frame cap is fixedly attached to the inner frame by a weak force enough to allow a user to manually detach the inner-frame cap.

Third Embodiment

In the sells-inking stamp of the present invention, the guide element extending in the upward-downward direction of the outer frame is a guide protrusion element or a guide groove element.

DESCRIPTION OF EMBODIMENTS

Based on the drawings, a self-inking stamp according to one embodiment of the present invention will now be described.

Figure 1:
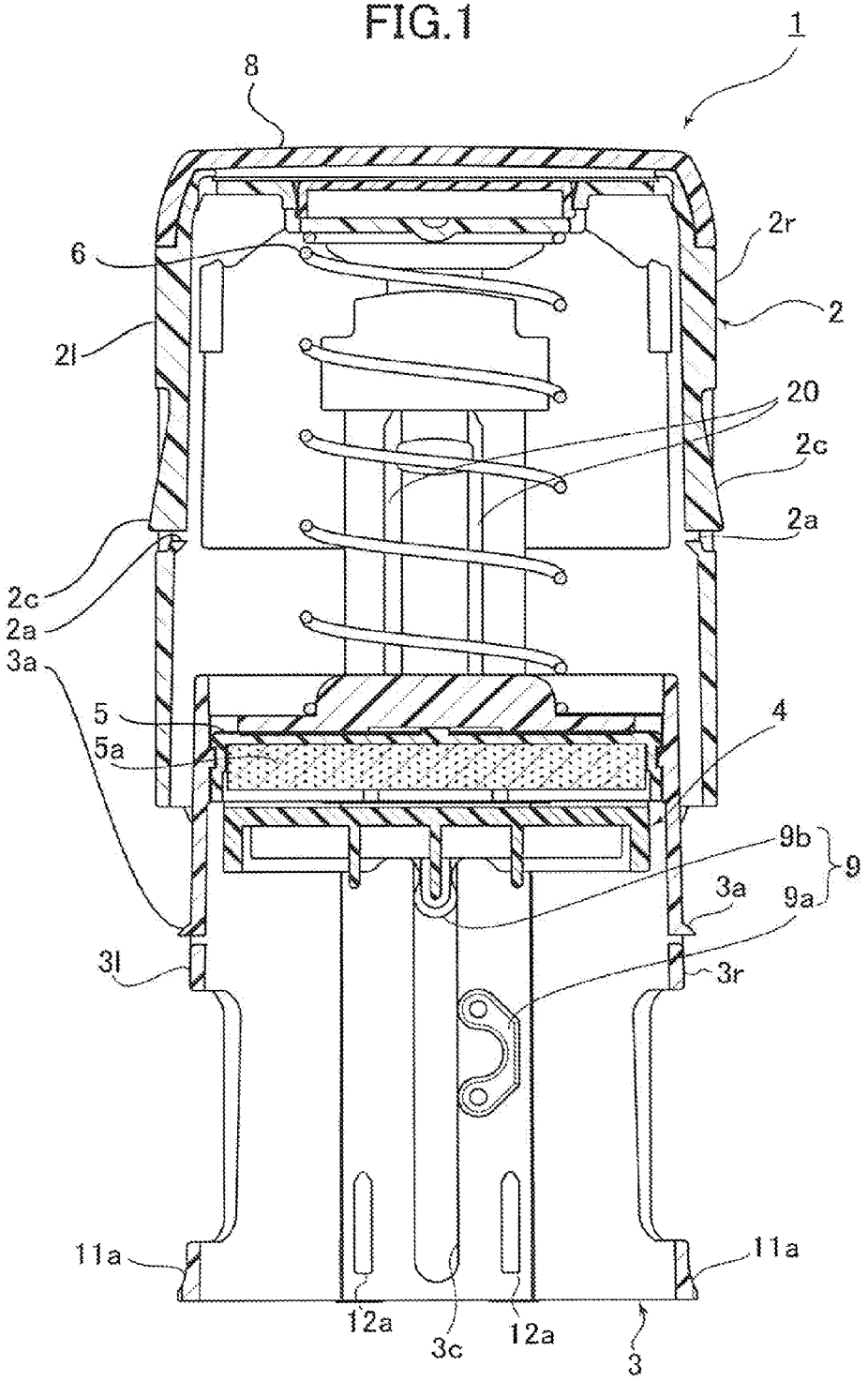
FIG. 1 is a vertical central sectional view in a right side view illustrating a self-inking stamp according to one embodiment of the present invention.
Figure 2:
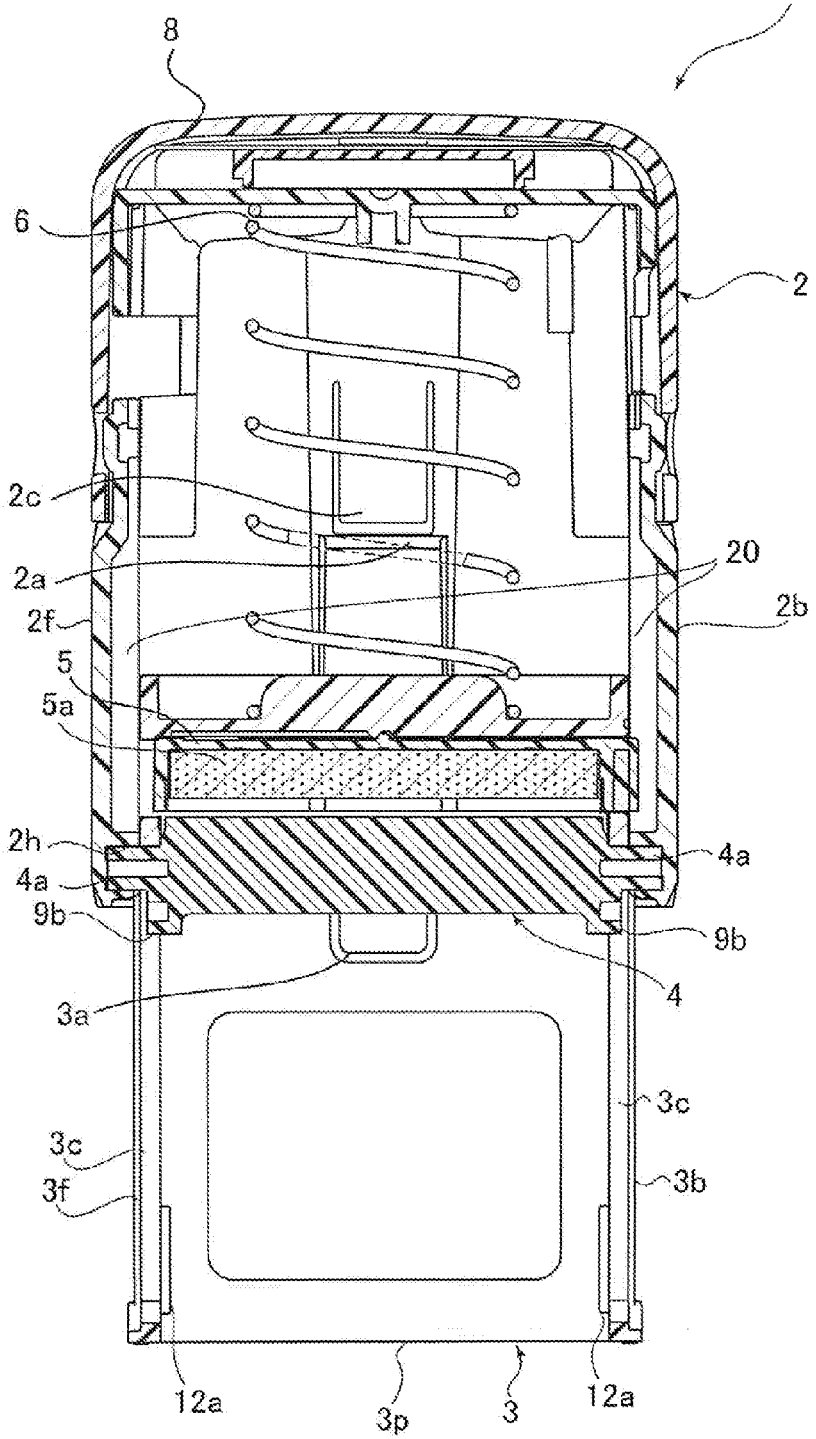
FIG. 2 is a vertical central sectional view in the right side view illustrating the self-inking stamp according to the embodiment of the present invention.

As illustrated in FIGS. 1 and 2, the self-inking stamp 1 comprises: an outer frame 2; an inner frame 3 configured to be guided inside the outer frame 2 in a slidingly movable manner in an upward-downward direction; a marking member 4 pivotally attached to a distal end of the outer frame 2 in a reversingly movable manner; an ink pad casing 5 attached to an upper end of the inner frame 5 and receiving an ink pad 5*a* in a downwardly-opened concave space thereof; an elastic member 6, such as a coil spring, biasing the inner frame 3 downwardly with respect to the outer frame 2; an inner-frame cap 7 (FIGS. 6, 7 and 8) configured to be attached to and held by the inner frame 3 while capping a lower end thereof; and a top-surface cover 8 attached to the outer frame 2 while capping a top surface thereof. The inner frame is guided inside the outer frame 2 by a guide element 20 extending in the upward-downward direction The outer frame 2 has right and left walls 2*r*, 2*l* each provided with an outer frame-side locking pawl 2*a* for locking the inner frame 3, and a release lever 2*c* for releasing a locked state between the outer frame-side locking pawl 2*a* and the inner frame 3. The outer frame-side locking pawl 2*a* is integrated with the outer frame 2 through an elastic portion. The outer frame 2 also has front and rear walls 2*f*, 2*b* each provided with a shaft hole 2*h* (FIG. 2) to which a horizontal rotary shaft 4*a* of the marking member 4 is pivotally attached.

As illustrated in FIG. 1, the inner frame 3 has front and rear walls 3*f*, 3*b* each formed with a vertical groove 3*c* for guiding the horizontal rotary shaft 4*a* of the marking member 4. The inner frame 3 has right and left walls 3*r*, 3*l* each provided with an inner frame-side lockable pawl 3*a* located at an intermediate height position on an outer surface thereof and configured to be engaged with the outer frame-side locking pawl 2*a*. The inner frame-side locking pawl 3*a* is integrated with the inner frame 3 through an elastic portion.

The inner frame 3 comprises a marking opening 3*p* formed at the lower end thereof to allow the marking member 4 to be exposed therethrough. The inner frame 3 also comprises a pair of inner frame-side concavoconvex engagement portions 11*a* each formed on an outer surface of a lower portion of a respective one of the right and left walls 3*r*, 3*l* and configured to allow the inner-frame cap 7 to be fixedly attached to the inner frame 3 by a relatively weak force.

The inner frame 3 further comprises a pair of inner frame-side marking-surface restriction concave/convex portions 12*a* each provided in an inner surface of a lower portion of a respective one of the front and rear walls 3*r*, 3*l* to extend in the upward-downward direction and configured to maintain a direction of the marking member in a marking state, in parallel relation to a target surface to be marked, with a high degree of accuracy, while ensuring a given horizontal position of the marking member 4 with respect to the inner frame 3.

Figure 3:
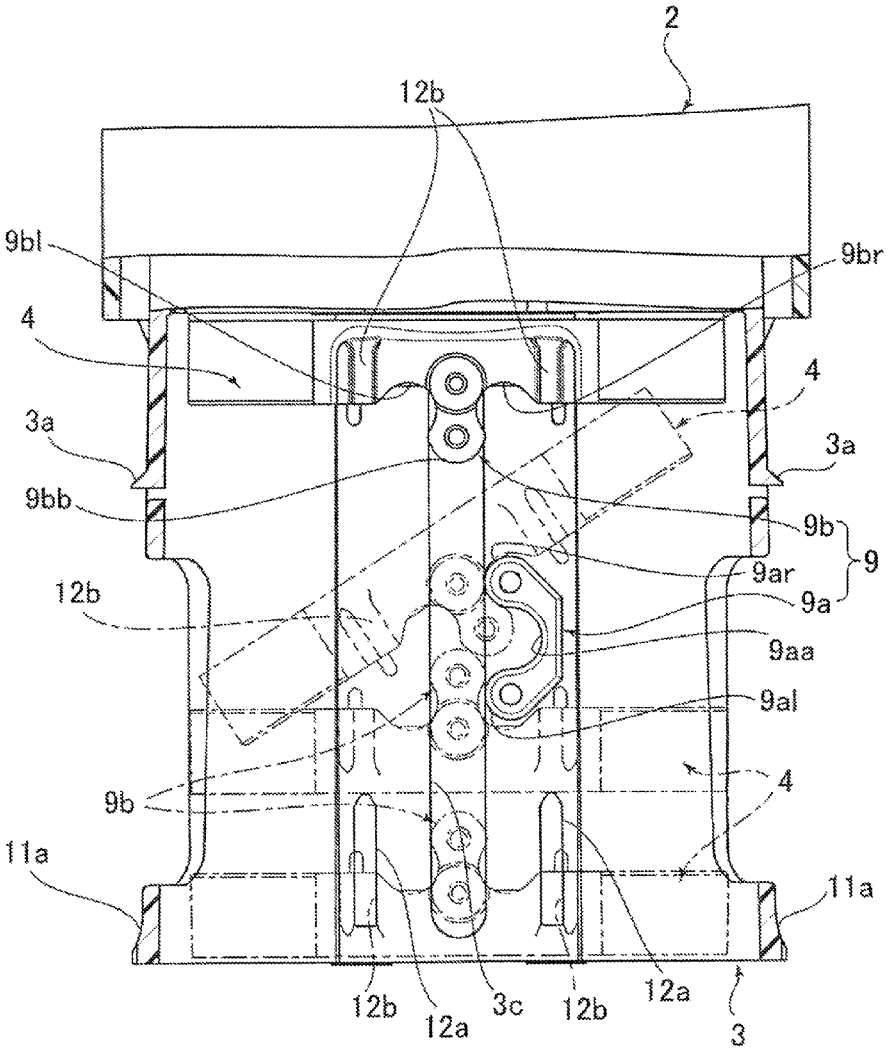
FIG. 3 is an explanatory diagram of an operation of the self-inking stamp according to the embodiment of the present invention.
Figure 4:
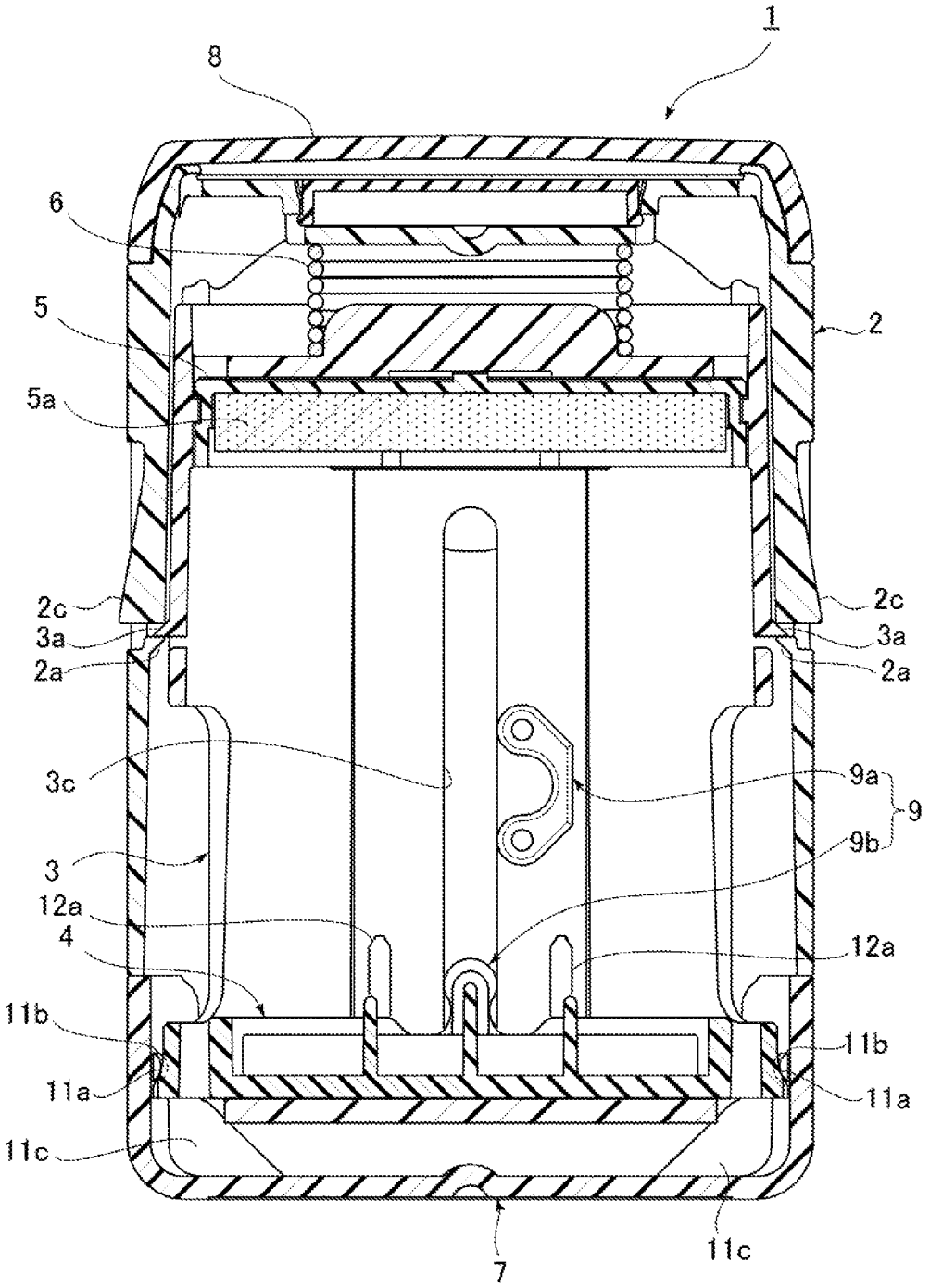
FIG. 4 is a vertical central sectional view in the right side view illustrating a locked state of the self-inking stamp according to the embodiment of the present invention.
Figure 5:
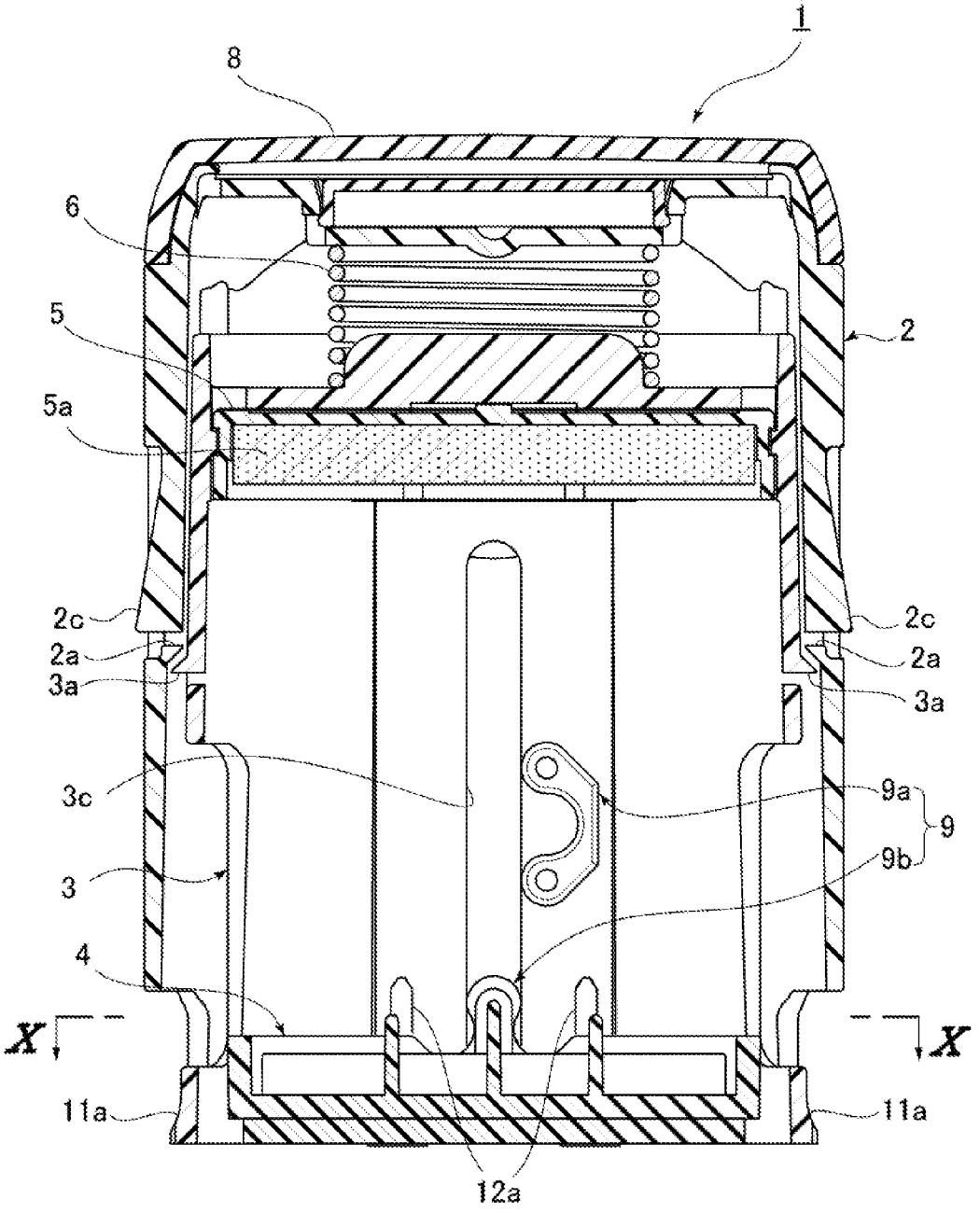
FIG. 5 is a vertical central sectional view in the right side view illustrating a marking preparation state of the self-inking stamp according to the embodiment of the present invention.

As illustrated in FIGS. 3, 4 and 5, a reversing mechanism 9 for reversingly rotating the marking member 4 along with a downward movement of the inner frame 3 within the outer frame 2 comprises a pair of first plate cams 9*a* each formed on the inner frame 3, beside a respective one of the vertical grooves 3*c* at an intermediate height position thereof, and a pair of second plate cams 9*h* formed on the marking member 4.

As illustrated in FIGS. 1 and 3, each of the first plate cams 9*a* has a first concave arc-shaped cam portion 9*aa*, and upper and lower first convex cam portions 9*ar*, 9*al* each smoothly connecting to a respective one of opposite ends of the first concave arc-shaped cam portion 9*aa*.

Each of the second plate cams 9*b* is formed on a respective one of front and rear sides of an upper portion of an outer periphery of the marking member 4, and has a second convex arc-shaped cam portion 9*bb* configured to come into fitting engagement with the first concave arc-shaped cam portion 9*aa* of a corresponding one of the first plate cams 9*a*, and right and left second concave arc-shaped cam portions 9*br*, 9*bl* each configured to come into fitting engagement with a respective one of the upper and lower first convex cam portions 9*ar*, 9*al*.

The marking member 4 comprises a pair of marking member-side marking-surface restriction concave/convex portions 12*b* each provided on respective front and rear sides of a respective one of the second cams 9*a* to extend in the upward-downward direction, in counterpart relation with a corresponding one of the inner frame-side marking-surface restriction concave/convex portions 12*a*, and configured to he engaged with the pair of the inner frame-side marking-surface restriction concave/convex portions 12*a* so as to maintain a direction of the marking member in the marking state, in parallel relation to a target surface to be marked, with a high degree of accuracy, while ensuring a given horizontal position of the marking member 4 with respect to the inner frame 3.

Figure 6:
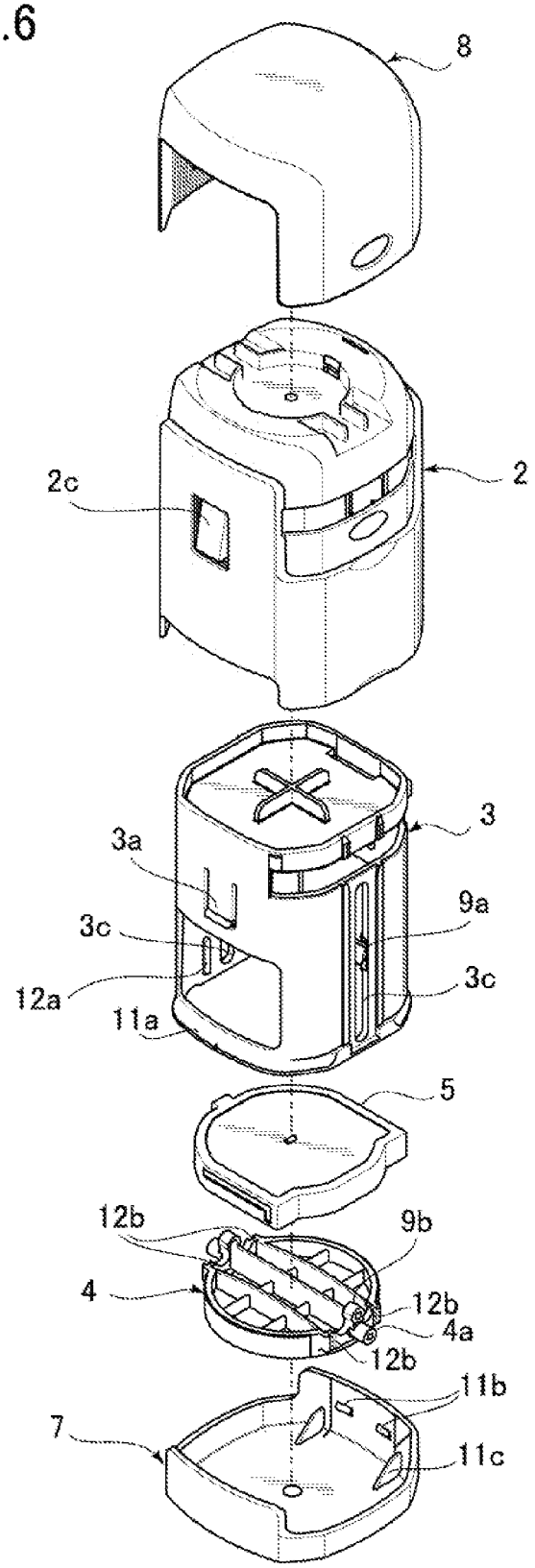
FIG. 6 is an explanatory exploded perspective view illustrating the self-inking stamp according to the embodiment of the present invention.
Figure 7:
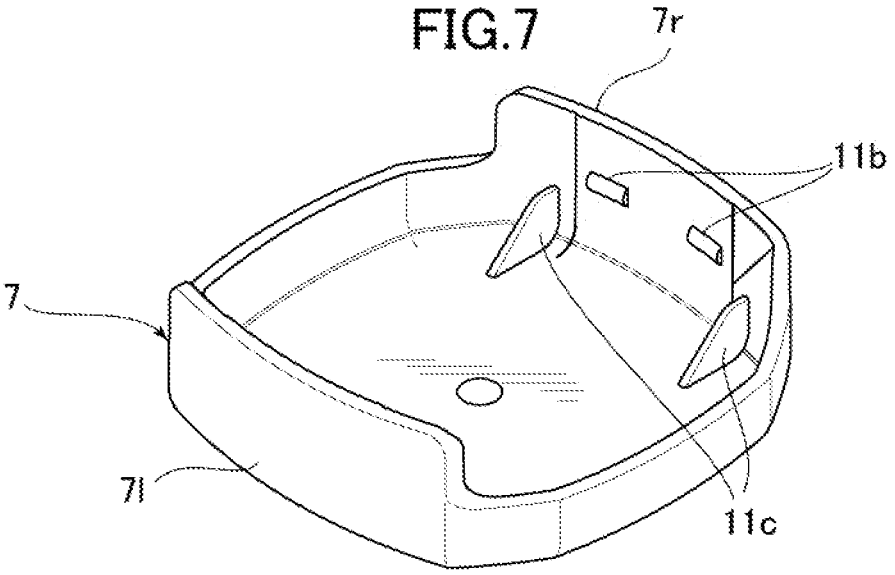
FIG. 7 is a perspective view illustrating an inner-frame cap in the embodiment of the present invention.
Figure 8:
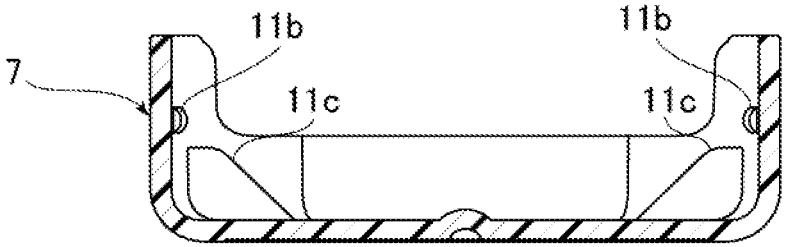
FIG. 8 is a vertically central sectional view in the right side view illustrating the inner-frame cap in the embodiment of the present invention.
Figure 9:
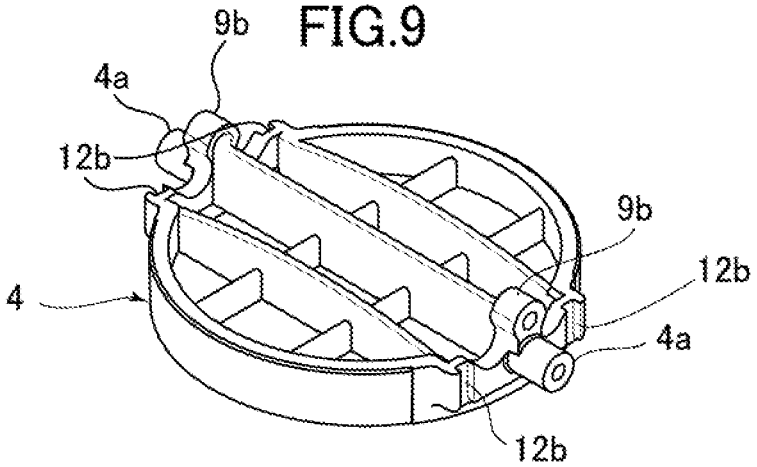
FIG. 9 is a perspective view illustrating a marking member in the embodiment of the present invention.
Figure 10A:
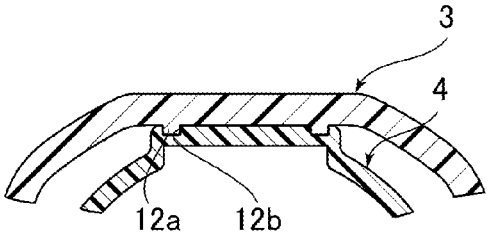
FIGS. 10(*a*) to 10(*d*) are explanatory horizontal sectional views illustrating the inner frame and the marking member in a marking state of in the self-inking stamp according to the embodiment of the present invention, taken along the line X-X in FIG. 5.
Figure 10B:
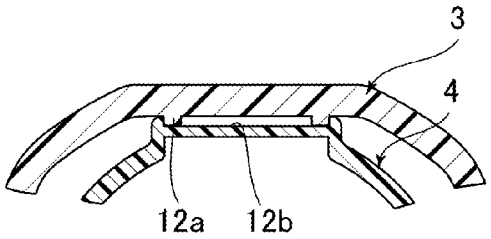
Figure 10C:
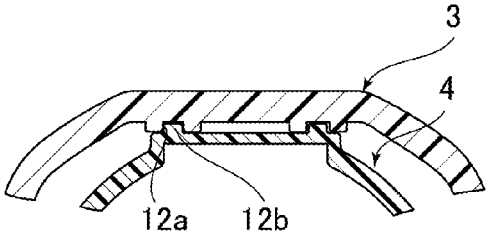
Figure 10D:
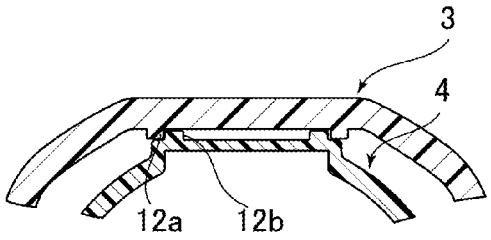

As illustrated in FIGS. 6, 7 and 8, the inner-frame cap 7 comprises two pairs of cap-side concave/convex portions 11*b* each pair of which are provided in/on an inner surface of a respective one of right and left walls 7*r*, 7*l* thereof, and two pairs of cap-side bottom protrusions 11*c* each pair of which are provided on a bottom surface and a respective one of right and left walls 7*r*, 7*l*, thereof. Each of the inner frame-side concavoconvex engagement portions 11*a* is configured to be engaged between corresponding ones of the two pairs of cap-side concave/convex portions 11*b* and the two pairs of cap-side bottom protrusions lie, i.e., engaged with a cap-side concavoconvex engagement portion consisting of the cap-side concave/convex portion 11*b* and the cap-side bottom protrusion 11*c*.

An operation of self-inking stamp 19 is as follows.

Marking Operation

In a marking preparation state of the self-inking stamp 1, the inner frame 3 is pushed out from the outer frame 2 under the stretching bias of the elastic member 6, the elastic member is stretched, and the marking member is passed against the ink pad, as illustrated in FIGS. 1 and 2. The ink pad 5*a* supported in a downwardly-oriented posture by the inner frame 3 comes into contact with the upwardly-oriented marking member 4, so that ink is applied from the ink pad 5*a* to the marking member 4, and a positional relationship between the inner frame 3 and the outer frame 2 in the upward-downward direction is set up and maintained. In the marking preparation state, in which the inner frame is pushed into the outer frame and the elastic member is compressed, the marking member is exposed from the marking opening and enabled to make a mark, each of the outer frame-side locking pawls 2*a* is not engaged with a respective one of the inner frame-side lockable pawls 3*a*, as illustrated in FIG. 5.

For a marking operation, the outer frame 2, specifically, the top-surface cover 8, is pushed against the stretching bias of the elastic member 6. Through the pushing operation, the inner frame 3 is pushed into the inner frame 3, and the marking member 4 is reversingly rotated by an action of the reversing mechanism 9, and oriented downwardly.

When the inner frame 3 is further pushed into the outer frame 2, each of the inner frame-side marking-surface restriction concave/convex portions 12*a* is engaged with a respective one of the marking member-side marking-surface restriction concave/convex portions 12*b*, so that it becomes possible to maintain a direction of the downwardly-oriented marking member 4 in parallel relation to a target surface to be marked, with a high degree of accuracy, while ensuring a given horizontal position of the marking member 4 with respect to the inner frame 3.

As illustrated in FIGS. 10(*a*) to 10(*d*), respective configurations of the inner frame-side marking-surface restriction concave/convex portion 12*a* and the marking member-side marking-surface restriction concave/convex portion 12*b* to be combined together may be set as follows.

(a) The inner frame-side marking-surface restriction concave/convex portion 12*a* may be formed as a pair of line-shaped inner frame-side vertical protrusions, whereas the marking member-side marking-surface restriction concave/convex portion 12*b* may be formed as a pair of line-shaped marking member-side vertical groove each configured to receive therein a respective one of the pair of line-shaped inner frame-side vertical protrusions.

(b) The inner frame-side marking-surface restriction concave/convex portion 12*a* may be formed as a pair of line-shaped inner frame-side vertical protrusions, whereas the marking member-side marking-surface restriction concave/convex portion 12*b* may be formed as a pair of line-shaped marking member-side vertical protrusions configured to clamp therebetween the pair of line-shaped inner frame-side vertical protrusions.

(c) The inner frame-side marking-surface restriction concave/convex portion 12*a* may be formed as a pair of line-shaped inner frame-side vertical grooves, whereas the marking member-side marking-surface restriction concave/convex portion 12*b* may be formed as a pair of line-shaped marking member-side vertical protrusions each configured to be received in a respective one of the pair of line-shaped inner frame-side vertical grooves.

(d) The inner frame-side marking-surface restriction concave/convex portion 12*a* may he formed as a pair of line-shaped inner frame-side vertical protrusions, whereas the marking member-side marking-surface restriction concave/convex portion 12*b* may be formed as a pair of line-shaped marking member-side vertical protrusions configured to be clamped between the pair of line-shaped inner frame-side vertical protrusions.

An operation of the reversing mechanism 9 for reversingly rotating the marking member 4 is as follows. As illustrated in FIG. 3, when the inner frame 3 is pushed into the outer frame 2 to a vicinity of the position indicated by the one-dot chain line, the right second concave arc-shaped cam portion 9*br* of each of the second plate cams 9*b* is fittingly engaged with the upper first convex cam portions 9*ar* of a corresponding one of the first plate cams 9*a*, and thereby the marking member 4 is rotated in a counterclockwise direction in FIG. 3.

When the inner frame 3 is further pushed into the outer frame 2, the second convex arc-shaped cam portion 9*bb* of the second plate cam 9*b* is fittingly engaged with the first concave arc-shaped cam portion 9*aa* of the first plate cam 9*a*, and thereby the marking member 4 is further rotated in the counterclockwise direction in FIG. 3.

When the inner frame 3 is further pushed into the outer frame 2, the left second concave arc-shaped cam portion 9*bl* of the second plate cam 9*b* is fittingly engaged with the lower first convex cam portions 9*al* of the first plate cam 9*a*, and thereby the marking member 4 is further rotated and oriented downwardly.

When the inner frame 3 is further pushed into the outer frame 2, the downwardly-oriented inner frame 3, namely the marking member 4 is moved downwardly. Then, the inner frame 3 is further pushed into the outer frame 2, the downwardly-oriented marking member 4 is exposed from the marking opening 3*p* and enabled to make a park on the target surface.

When the outer frame 2, specifically, the top-surface cover 8, is released from the pushing after completion of the marking operation, the inner frame 3 is pushed out from the outer frame 2 according to the stretching bias of the elastic member 6, and returned to the marking preparation state. In the returning process, the reversing mechanism 9 operates reversely as compared to the above operation, so that the marking member 4 is oriented upwardly.

Locking Operation

In the marking preparation state, the inner-frame cap 7 is engaged with the lower end of the inner frame 3. Based on the engagement between each of the inner frame-side concavoconvex engagement portions 11*a* and a respective one of the sets of the cap-side concave/convex portions 11*b* and the cap-side bottom protrusions 11*c*, the inner-frame cap 7 is attached to the inner frame 3 by a weak force enough to allow a user to manually detach the inner-frame cap 7.

In the marking preparation state, when the outer frame 2, specifically, the top-surface cover 8, is pushed against the stretching bias of the elastic member 6, the elastic member 6 is thereby compressed, the inner frame 3 is pushed into the outer frame 2, and each of the outer frame-side locking pawls 2*a* is engaged with a respective one of the inner frame-side lockable pawl 3*a*, so as to bring the self-inking stamp into a locked state, as illustrated in FIG. 4. The engagement between each of the outer frame-side locking pawls 2*a* and a respective one of the inner frame-side lockable pawl 3*a* maintains, i.e., locks, a positional relationship between the inner frame 3 and the outer frame 2. In the locked state, the marking member 4 protrudes from the marking opening 3*p* by several mm. Thus, the inner-frame cap 7 may be detached from the lower end of the inner frame 3 so as to perform a marking operation.

An unlocking operation is performed by pushing the release levers 2*c* of the right and left walls 2*r*, 2*l* of the outer frame 2 to release the engagement between each of the outer frame-side locking pawls 2*a* and a respective one of the inner frame-side lockable pawl 3*a*. When the locked state is released, the self-inking stamp is placed in the marking preparation state.

What is claimed is:

1. A self-inking stamp having a marking state in which it can carry out a marking operation, a marking preparation state, and a locked state, and comprising:

an elastic member having a stretched state when the stamp is in the marking preparation state and a compressed state when the stamp is in the marking state and the locked state;

an outer frame movable in a downward direction during a marking operation and movable in an upward direction on completion of a marking operation, wherein the outer frame is normally biased in the upward direction by the elastic member;

a guide element extending in an upward-downward direction;

an inner frame movable inside the outer frame in an upward-downward direction of the outer frame with respect to the outer frame under a bias of the elastic member, while being guided by the guide element, and being pushed out from the outer frame when the stamp is in the marking preparation state, the inner frame having an upper portion fixedly provided with an ink pad oriented downwardly and a lower end formed with a marking opening, wherein the elastic member is disposed between an upper portion of the outer frame and the upper portion of the lower frame to bias the inner frame downwardly with respect to the outer frame;

a marking member pivotally attached to a lower portion of the outer frame and configured to flip in conjunction with the upward-downward movement of the inner frame with respect to the outer frame wherein the marking member protrudes downwardly from the marking opening of the inner frame when the stamp is in the marking state and is pressed against the ink pad provided on the upper portion of the inner frame when the stamp is in the marking preparation state;

locking means for locking a positional relationship between the outer frame and the inner frame, when the stamp is in a locked state in which the inner frame is pushed inside the outer frame against a bias force of the elastic member and the elastic member is compressed, and the marking member is exposed and protrudes downwardly from the marking opening, and for releasing the outer frame and the inner frame from the locked positional relationship to place the stamp in a marking preparation state in which the inner frame is pushed out from the outer frame, the elastic member is stretched, and the marking member is pressed against the ink pad; and an inner-frame cap configured to be detachably attached to the inner frame while capping the marking opening, and pushing the inner frame upwardly with respect to the outer frame to a position where the locking means becomes operative.

2. The self-inking stamp as defined in claim 1, wherein:

the inner frame has an inner frame-side vertical portion provided one of in and on an inner surface thereof to extend in the upward-downward direction; and the marking member has a marking member-side vertical portion provided one of in and on an outer surface thereof in counterpart relation with the inner frame-side vertical portion to extend in the upward-downward direction in the marking state, one of the inner frame-side vertical portion and the marking member-side vertical portion has a convex profile and the other of the inner frame-side vertical portion and the marking member-side vertical portion has a concave profile, and wherein a direction of the marking member in the marking state is restricted by an engagement between the inner frame-side vertical portion and the marking member-side vertical convex/concave counterpart portion.

3. The self-inking stamp as defined in claim 1, wherein:

the inner frame has an inner frame-side concavoconvex engagement portion provided on an outer surface thereof; and the inner-frame cap has a cap-side concavoconvex engagement portion provided on an inner surface thereof, and wherein, when the inner-frame cap is attached to the inner frame, the inner-frame cap is fixedly attached to the inner frame by a weak force enough to allow a user to manually detach the inner-frame cap.

4. The self-inking stamp as defined in claim 1, wherein the guide element extending in the upward-downward direction of the outer frame is a guide protrusion element or a guide groove element.

5. The self-inking stamp as defined in claim 1, wherein the locking means comprises:

right and left outer frame-side locking pawls provided in the right and left walls, respectively, of the outer frame, right and left inner frame-side lockable pawls provided at an intermediate height on an outer surface of the right and left walls, respectively, of the inner frame, the right and left inner frame-side lockable pawls being configured to be engaged with the right and left outer frame-side locking pawls when the locking means is in the operative state and the stamp is in the marking state, and a release lever configured to release the engagement between the right and left outer frame-side locking pawls and the right and left inner frame-side lockable pawls.

* * * * *